US012498198B2

(12) United States Patent
Rascon et al.

(10) Patent No.: US 12,498,198 B2
(45) **Date of Patent: *Dec. 16, 2025**

(54) ENERGETIC MATERIAL CONTAINER HAVING A HEAVY INERT GAS INSULATING LAYER

(71) Applicant: Raytheon Company, Arlington, VA (US)

(72) Inventors: John Rascon, Tucson, AZ (US); Christopher M. Schott, Andover, KS (US); Mark J. Meisner, Tucson, AZ (US)

(73) Assignee: Raytheon Company, Arlington, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/627,973

(22) Filed: Apr. 5, 2024

(65) Prior Publication Data

US 2025/0314455 A1 Oct. 9, 2025

(51) Int. Cl.

| | |
|---|---|
| ***F41F 3/077*** | (2006.01) |
| ***B65D 81/38*** | (2006.01) |
| ***B65D 85/30*** | (2006.01) |

(52) U.S. Cl.

CPC ..... *F41F 3/077* (2013.01); *B65D 81/3806* (2013.01); *B65D 81/3876* (2013.01); *B65D 85/30* (2013.01)

(58) Field of Classification Search

CPC ..... F42B 39/00; F42B 39/14; F42B 39/18; F42B 39/30; F42B 39/24; F42B 12/22; F41F 3/077; B65D 81/3806; B65D 81/3876; B65D 81/3883; B65D 81/3886

See application file for complete search history.

(56) References Cited

U.S. PATENT DOCUMENTS

| | | | | |
|---|---|---|---|---|
| 3,158,062 | A | 11/1964 | Feiler | |
| 3,992,997 | A * | 11/1976 | McCubbin | F42B 39/18 102/481 |
| 5,678,725 | A * | 10/1997 | Yamada | A47J 41/0077 220/592.21 |
| 6,179,155 | B1 * | 1/2001 | Komiya | F16L 59/06 220/592.2 |
| 6,526,860 | B2 | 3/2003 | Facciano et al. | |
| 11,267,639 | B2 | 3/2022 | Guerdrum et al. | |
| 11,542,088 | B2 | 1/2023 | Barfoot et al. | |
| 11,667,455 | B2 | 6/2023 | Barfoot et al. | |

(Continued)

*Primary Examiner* — Benjamin P Lee

(74) *Attorney, Agent, or Firm* — Schwegman Lundberg & Woessner, P.A.

(57) ABSTRACT

Heavy inert gas insulation layer(s) are provided for containers configured to contain components that include an energetic material. The heavy inert gas insulation layer delays desensitization or inhibits premature reaction of the energetic material due to high external temperatures. The layers may be formed in hollow walls of the container itself or as inserts that are attached to the container. An inert gas fills a sealed void space in the walls or the insert. The inert gas has a density of at least 1.5 Kg/m$^3$ and a thermal conductivity (Tcond_gas) of no greater than two-thirds of a thermal conductivity of air (Tcond_air) to form the heavy inert gas insulation layer. The inert gas may be Argon, Krypton, Xenon or a synthetic gas and is suitably held at a pressure of 760 Torr (1 atmosphere) or greater at sea level.

19 Claims, 6 Drawing Sheets

(56) References Cited

U.S. PATENT DOCUMENTS

| | | | | |
|---|---|---|---|---|
| 11,786,076 | B2 | 10/2023 | Tolman et al. | |
| 12,065,990 | B1 * | 8/2024 | Rascon | F02K 9/346 |
| 12,140,408 | B1 * | 11/2024 | Rascon | F42B 12/207 |
| 12,298,115 | B2 * | 5/2025 | Rascon | F42B 39/18 |
| 2004/0200232 | A1 * | 10/2004 | Gano, III | B65D 81/3816 62/457.2 |
| 2007/0234921 | A1 * | 10/2007 | Han | E21B 43/1185 102/318 |
| 2008/0314903 | A1 * | 12/2008 | Ohlson | F42B 39/14 220/316 |
| 2012/0012021 | A1 * | 1/2012 | Dryer | F42B 15/10 29/428 |
| 2012/0285972 | A1 * | 11/2012 | Fu | B65D 81/3869 220/592.2 |
| 2017/0095120 | A1 | 4/2017 | Tolman et al. | |
| 2017/0313492 | A1 | 11/2017 | Seiders et al. | |
| 2018/0037394 | A1 | 2/2018 | Seiders et al. | |
| 2018/0216912 | A1 * | 8/2018 | Leroy | B32B 15/043 |
| 2018/0240560 | A1 * | 8/2018 | Liu | G21F 5/005 |
| 2022/0047119 | A1 | 2/2022 | Tolman et al. | |
| 2022/0144527 | A1 | 5/2022 | Barfoot et al. | |
| 2023/0089527 | A1 | 3/2023 | Barfoot et al. | |
| 2024/0044632 | A1 * | 2/2024 | Ulken | A62C 3/16 |
| 2025/0101933 | A1 * | 3/2025 | Rascon | F02K 9/34 |
| 2025/0102281 | A1 * | 3/2025 | Rascon | F42B 39/18 |

* cited by examiner

100

THERMAL CONDUCTIVITY (W/mK)

| | |
|---|---|
| PHENOLIC RESIN | 1–1.5 |
| AIR | 0.026 |
| ARGON | 0.017 |
| KRYPTON | 0.0087 |
| XENON | 0.0052 |

102

ENERGETIC MATERIAL CONTAINER HAVING A HEAVY INERT GAS INSULATING LAYER

BACKGROUND

Field

This disclosure relates to containers such as launch tubes, launch canisters and shipping containers for components such as missiles, rockets, projectiles, motors or pyrotechnic items and components that include energetic materials such as explosives or propellant, and more particularly to a container configuration to delay desensitization or inhibit premature reaction, up to and including detonation of the energetic material due to high external temperatures.

Description of the Related Art

Containers such as launch tubes, launch canisters and shipping containers are configured to contain components such as missiles, rockets, projectiles, motors or pyrotechnic items and components that include energetic materials such as explosives or propellant. Such containers include internal support features that engage one or more physical features of the component to support the component inside the container. For example, a launch tube may include clamps or a rubber liner that support the missile, rocket or projectile. A launch canister may include a rail system or clamps that supports the launch tube. A shipping container may include a cradle system or dunnage for supporting a plurality of components, launch tubes or missiles. A launch canister differs from a shipping container in that the canister is integrated into the launch system. In each case, the container should also provide sufficient insulation to delay desensitization or inhibit premature reaction of the energetic material due to high external temperatures. This insulation is most typically and primarily provided by air gaps between the energetic material and the external environment and secondarily by heat resistant materials such as phenolic resins that may line the inner surfaces of the launch tubes or canisters. The containers typically have a double-walled metal construction in which the inner and outer metal walls are supported by ribs or a corrugated structure. The space between the walls is filled with air.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides a heavy inert gas insulation layer for containers configured to contain components that include an energetic material. The layer may be integrated into the container walls or provided in inserts attached to the container. The heavy inert gas insulation layer delays desensitization or inhibits premature reaction of the energetic material due to high external temperatures.

In an embodiment, an insulated container includes a hollow metal shell having inner and outer walls that define a sealed void space therein. A component including an energetic material is positioned inside the hollow metal shell behind its inner walls. Internal support features coupled to the hollow metal shell engage one or more physical features of the component to support the component inside the hollow metal shell. An inert gas fills the sealed void space. The inert gas has a density of at least 1.5 $Kg/m^3$ and a thermal conductivity (Tcond_gas) of no greater than two-thirds of a thermal conductivity of air (Tcond_air) to form the heavy inert gas insulation layer.

In an embodiment, the inert gas is selected from Argon (Ar), Krypton (Kr), or Xenon (Xe) or a synthetic gas. The inert gas in the sealed void space is held at a pressure of 760 Torr (1 atmosphere) or greater at sea level.

In an embodiment, the hollow metal shell includes ribs or a corrugated structure between the inner and outer walls that provides structural support. The ribs or corrugated structure includes openings therein to contiguously define the sealed void space.

In an embodiment, the container may also include an insulating layer formed of a burn resistant material on an interior surface of the inner walls of the hollow metal shell. The thermal conductivity of the inert gas being less than one one-hundredth the thermal conductivity of the burn resistant material.

In an embodiment, the container further includes a cover adapted to an opening in the hollow metal shell. The cover itself includes a hollow metal shell that defines a sealed void space that is filled with the inert gas. The container and cover form a heavy inert gas insulation layer around the component.

In an embodiment, additional insulation is provided by positioning a plurality of inserts on an interior or exterior surface of the container. Each insert itself includes a hollow metal shell defining a sealed void space that is filled with an inert gas. If placed on an interior surface of the container, the inserts are positioned so as not to interfere with the internal support features.

In an embodiment, an existing container whose walls do not provide a heavy inert gas insulation layer can be retro-fit by positioning a plurality of inserts on an interior or exterior surface of the container. Each insert itself includes a hollow metal shell defining a sealed void space that is filled with an inert gas. If placed on an interior surface of the container, the inserts are positioned so as not to interfere with the internal support features.

These and other features and advantages of the disclosure will be apparent to those skilled in the art from the following detailed description of preferred embodiments, taken together with the accompanying drawings, in which:

DETAILED DESCRIPTION

Heavy inert gas insulation layer(s) are provided for containers configured to contain components that include an energetic material. The heavy inert gas insulation layer delays desensitization or inhibits premature reaction of the energetic material due to high external temperatures. The layers may be formed in the hollow double-walled structure of the container itself or as inserts that are attached to the container either internally or externally. An inert gas fills a sealed void space in the double-walled structure or the insert. The inert gas has a density of at least 1.5 $Kg/m^3$ and a thermal conductivity (Tcond_gas) of no greater than two-thirds of a thermal conductivity of air (Tcond_air) to form the heavy inert gas insulation layer. The inert gas may be Argon (Ar), Krypton (Kr), Xenon (Xe) or a synthetic gas and is suitably held at a pressure of 760 Torr (1 atmosphere) or greater at sea level and a temperature of 25 C.

Figures 1A, 1B:
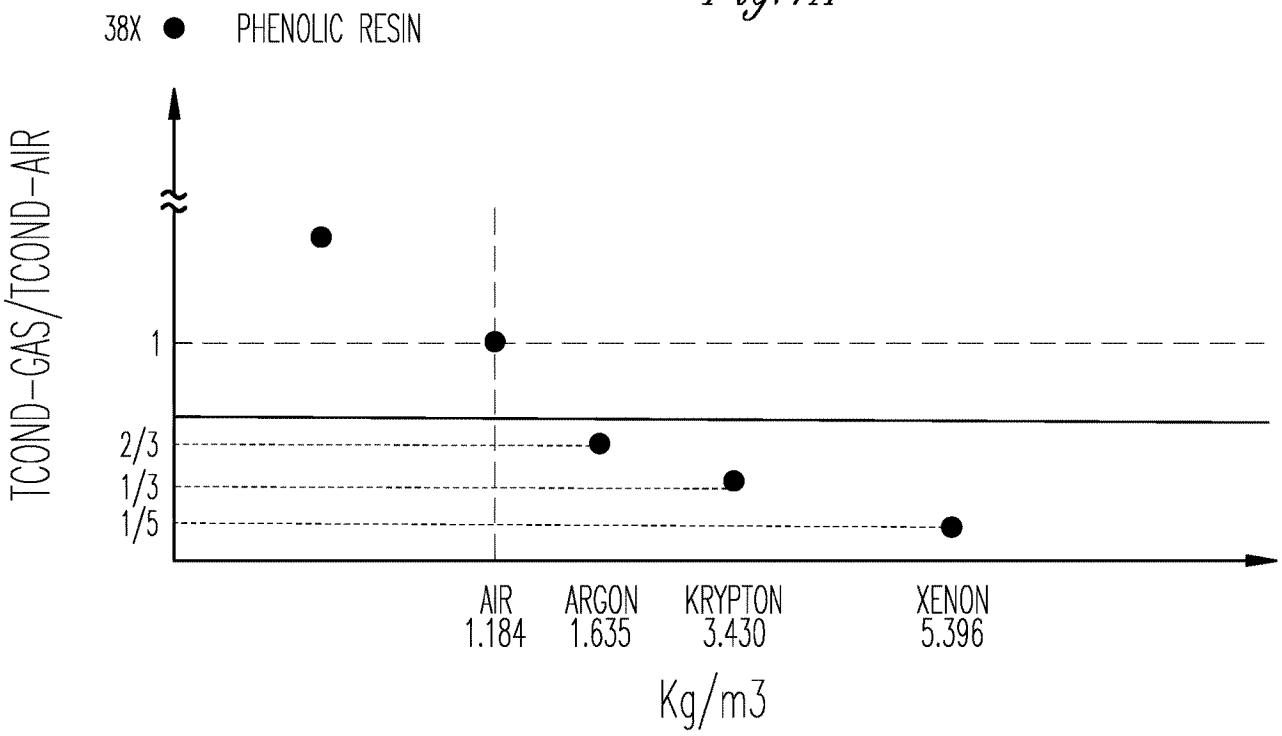
FIGS. 1A and 1B are a table and a plot comparing the thermal conductivity of various heavy inert gases to air.

Referring now to table 100 of FIG. 1A and a plot 102 of the relative thermal conductivity of different heavy inert gases to air in FIG. 1B, at sea level and a temperature of 25 C, air has a thermal conductivity of approximately 0.026 W/mK, phenolic resin between 1 and 1.5 W/mK and Ar, Kr and Xe have thermal conductivities of approximately 0.017, 0.0087 and 0.0052 W/mK, respectively. Ar, Kr and Xe have thermal conductivities of approximately two-thirds, one-third and one-fifth that of air. Any suitable inert gas will have a thermal conductivity (Tcond_gas) no greater than two-thirds the thermal conductivity of air (Tcond_air). This provides a substantial thermal insulating benefit over air, and a very substantial thermal insulting improvement over phenolic resin. The heavy inert gas has a density greater than 1.5 kg/m3 (by comparison air is 1.29 kg/m3). Inert gases from Group 8A of the periodic table will not react with temperature or other compounds and thus are very stable and safe over the life of the container. Heavy inert gases (those having a density greater than air) include heavier particles, which transfer heat more slowly and thus are better insulators than air.

Without loss of generality, the disclosure will be described in the context of container such as launch tubes, launch canisters and shipping containers that are configured to contain missiles. Other types of containers may be configured to contain and support components that include energetic materials such as explosives or propellant. For example, containers may be configured to contain rockets, projectiles, motors or pyrotechnic items for storage, transport or deployment.

Figure 2B:
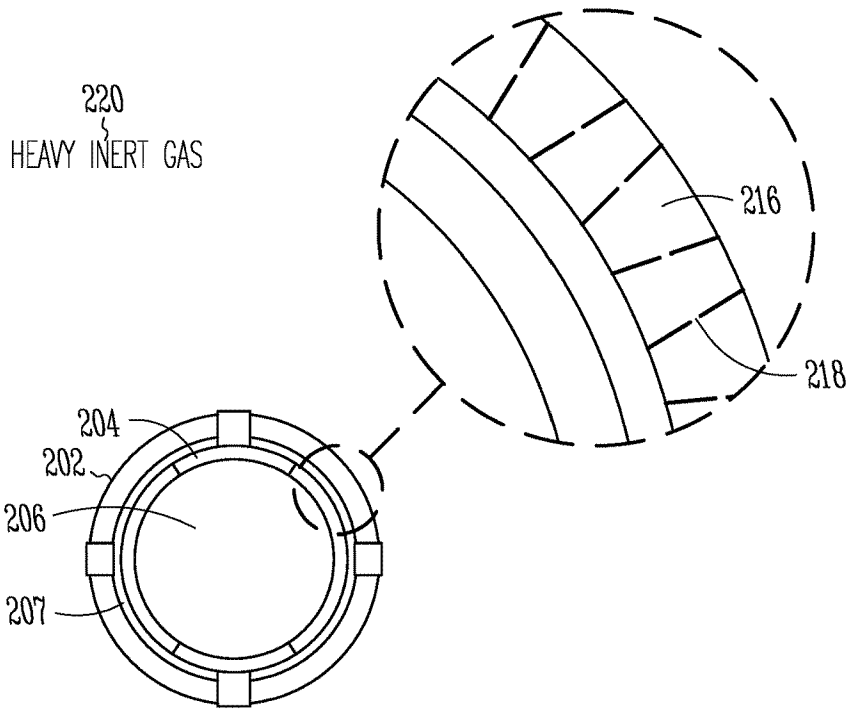
FIGS. 2A-2B illustrate an embodiment of a missile contained inside a launch tube in which a heavy inert gas insulating layer is formed within the walls of the launch tube.
Figure 2A:
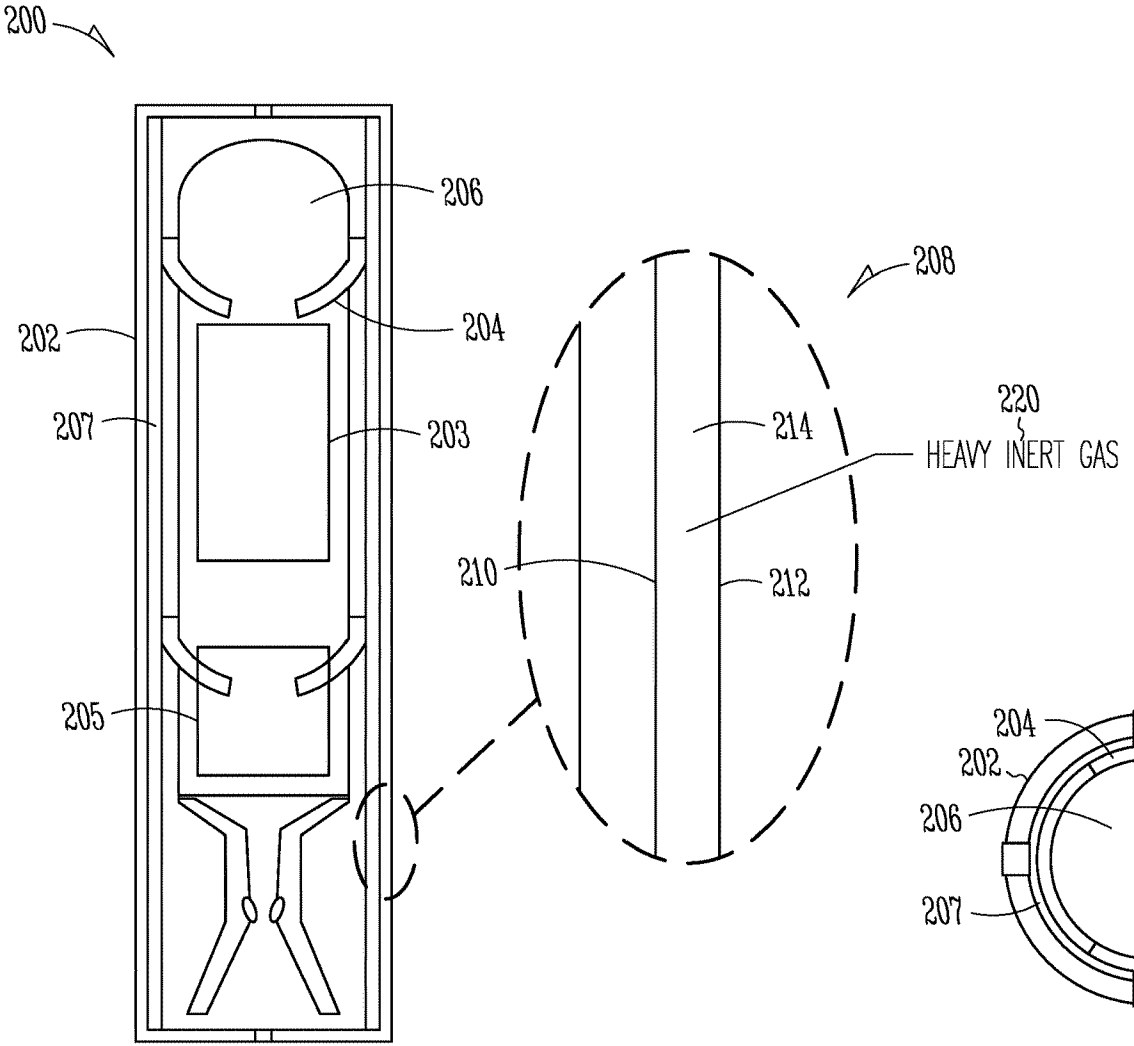

Referring now to FIGS. 2A and 2B, an embodiment of an energetic material container 200 includes a launch tube 202 including a system of clamps 204 that support a missile 206 inside the launch tube 202. Missile 206 includes energetic material in the form of an explosive warhead 203, rocket propellant 205, or other components containing energetic materials. A layer of heat resistant material 207 such as ablative material is suitably formed on the inner surface of the launch tube 202. The launch tube 202 is a double-walled structure that defines a hollow metal shell 208 having inner and outer metal walls 210, 212 that define a sealed void space 214. The double-walled structure may include ribs, a corrugated structure 216 or the like to provide mechanical support. If included, this support is configured (e.g., with openings 218) such that the sealed void space 214 is a single contiguous volume. A vacuum is pulled on single contiguous volume, which is then filled with a heavy inert gas 220 at a pressure of 760 Torr (1 atm) or more (assuming operation of the rocket at or near sea level and room temperature of 25 C) and sealed to form a heavy inert gas insulation layer that surrounds the missile 206 with the possible exception of the top cover of the launch tube. The top cover may be a standard configuration or configured as a separate heavy inert gas insulating layer. In alternate embodiments, the container could be divided into multiple sealed void spaces each defining a single contiguous volume that is filled with a heavy inert gas.

Figure 3B:
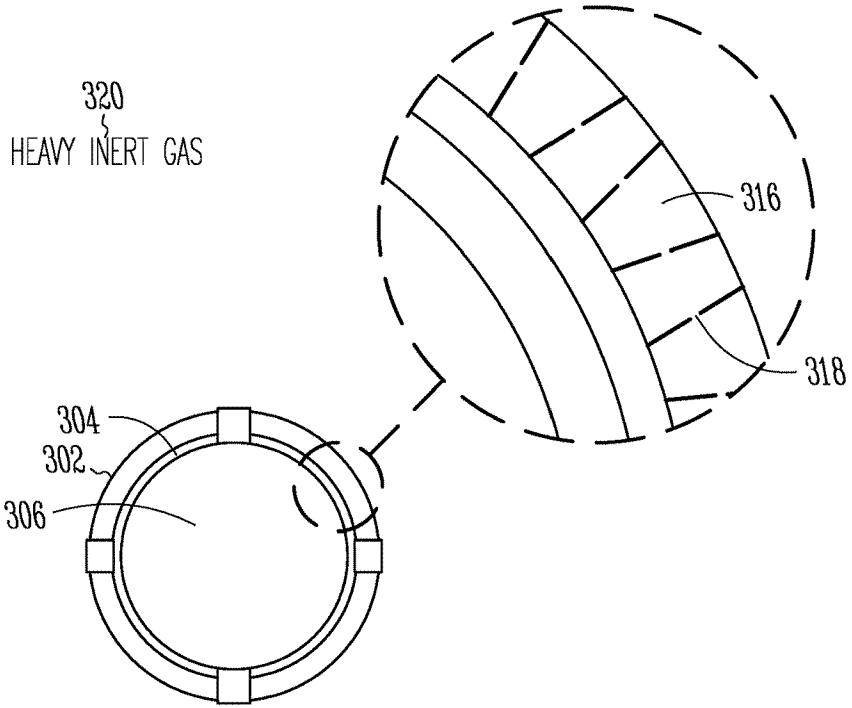
FIGS. 3A-3B illustrate another embodiment of a missile contained inside a launch tube in which a heavy inert gas insulating layer is formed within the walls of the launch tube.
Figure 3A:
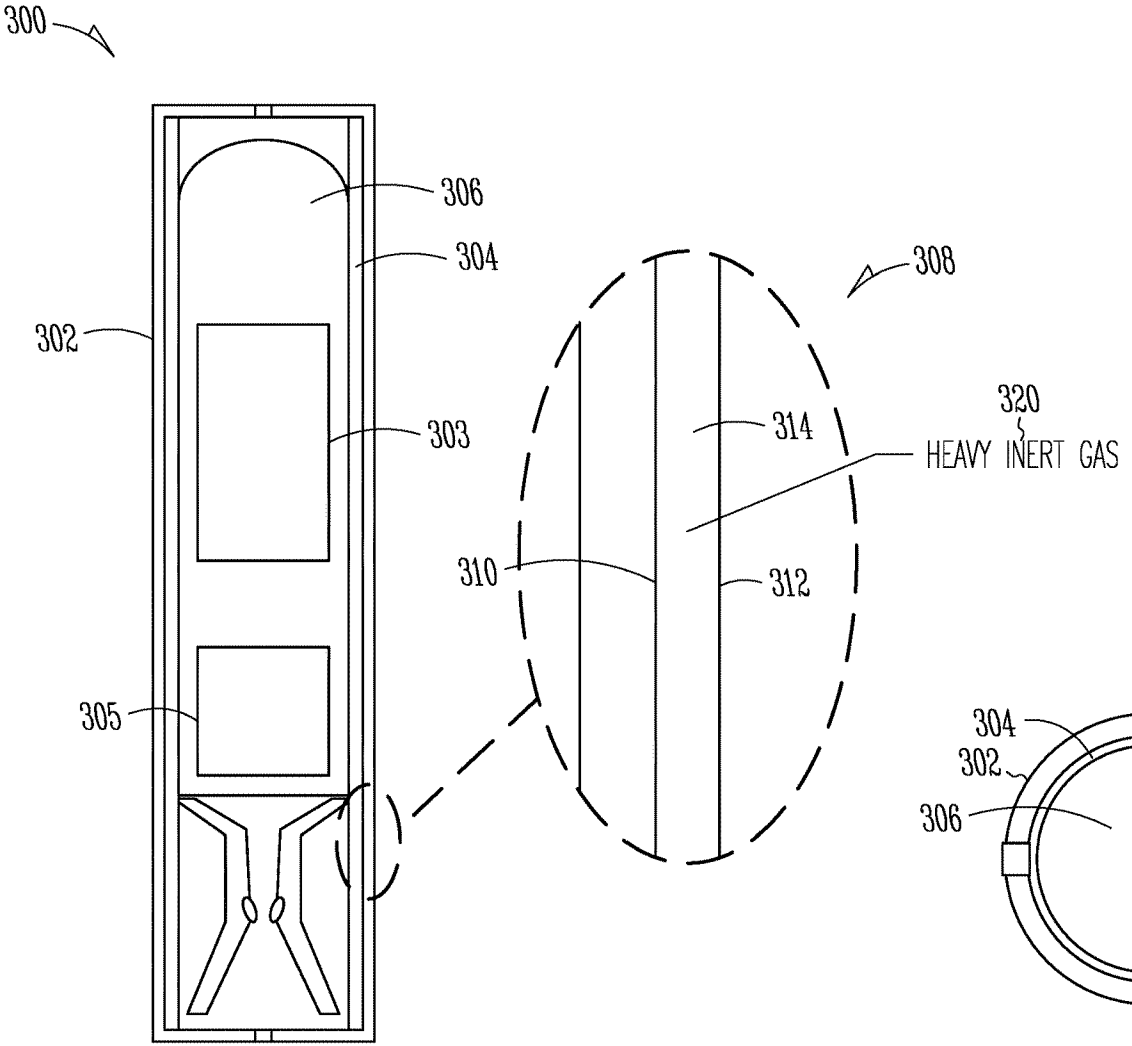

Referring now to FIGS. 3A and 3B, an embodiment of an energetic material container 300 includes a launch tube 302 including an inner rubber sleeve 304 that supports a missile 306 inside the launch tube 302. Missile 306 includes energetic material in the form of an explosive warhead 303, rocket propellant 305, or other components containing energetic materials. Launch tube 302 is a double-walled structure that defines a hollow metal shell 308 having inner and outer metal walls 310, 312 that define a sealed void space 314. The double-walled structure may include ribs, a corrugated structure 316 or the like to provide mechanical support. If included, this support is configured (e.g., with openings 318) such that the sealed void space 314 is a single contiguous volume. A vacuum is pulled on single contiguous volume, which is then filled with a heavy inert gas 320 at a pressure of 760 Torr (1 atm) or more (assuming operation of the rocket at or near sea level and room temperature of 25 C) and sealed to form a heavy inert gas insulation layer that surrounds the missile 306 with the possible exception of the top cover of the launch tube. The top cover may be a standard configuration or configured as a separate heavy inert gas insulating layer. In alternate embodiments, the container could be divided into multiple sealed void spaces each defining a single contiguous volume that is filled with a heavy inert gas.

Figure 4B:
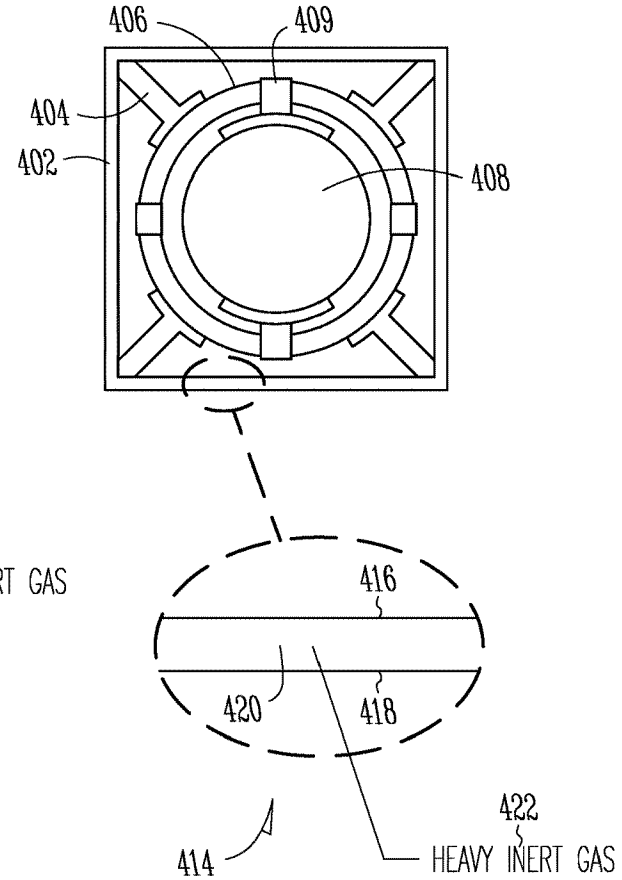
FIGS. 4A-4B illustrate an embodiment of a missile launch tube contained inside a launch canister in which a heavy inert gas insulating layer is formed within the walls of the launch canister.
Figure 4A:
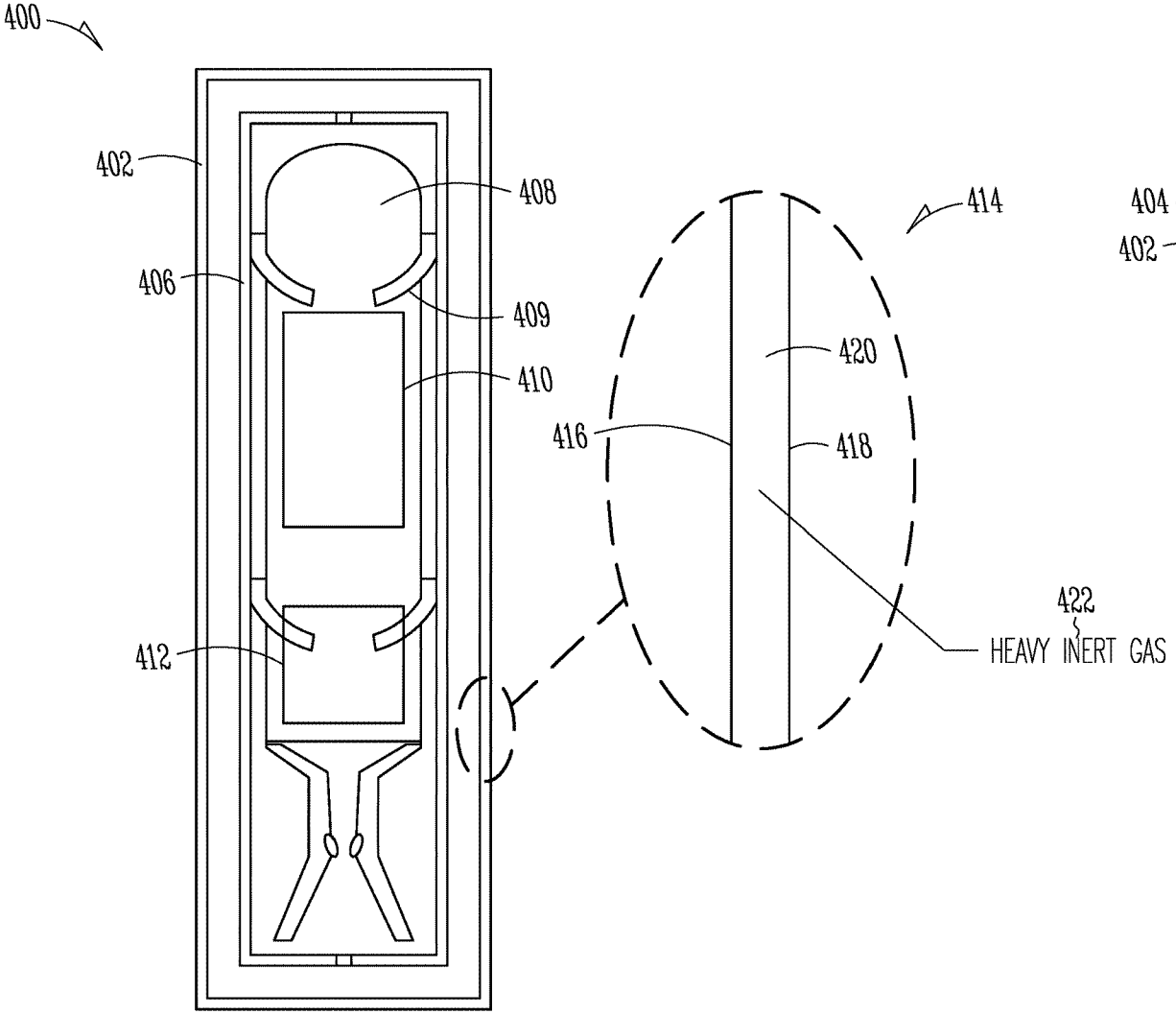

Referring now to FIGS. 4A and 4B, an embodiment of an energetic material container 400 includes a launch canister 402 including a system of rails 404 that supports a launch tube 406 that contains a missile 408 supported by clamps 409. Alternately, the launch canister 402 can be configured to support the missile 408 directly without launch tube 406. Missile 408 includes energetic material in the form of an explosive warhead 410, rocket propellant 412, or other components containing energetic materials. A layer of heat resistant material such as ablative material is suitably formed on the inner surface of the launch tube or in the case the missile is directly contained in the launch canister on the inner surface of the launch canister.

Launch canister 402 is a double-walled structure that defines a hollow metal shell 414 having inner and outer metal walls 416, 418 that define a sealed void space 420. The double-walled structure may include ribs, a corrugated structure or the like to provide mechanical support. If included, this support is configured (e.g., with openings) such that the sealed void space 420 is a single contiguous volume. A vacuum is pulled on single contiguous volume, which is then filled with a heavy inert gas 422 at a pressure of 760 Torr (1 atm) or more (assuming operation of the rocket at or near sea level and room temperature of 25 C) and sealed to form a heavy inert gas insulation layer that surrounds the missile 408 with the possible exception of the top cover of the launch canister. The top cover may be a standard configuration or configured as a separate heavy inert gas insulating layer. In alternate embodiments, the canister could be divided into multiple sealed void spaces each defining a single contiguous volume that is filled with a heavy inert gas. Launch tube 406 may or may not be configured with a heavy inert gas insulating layer.

Figure 5:
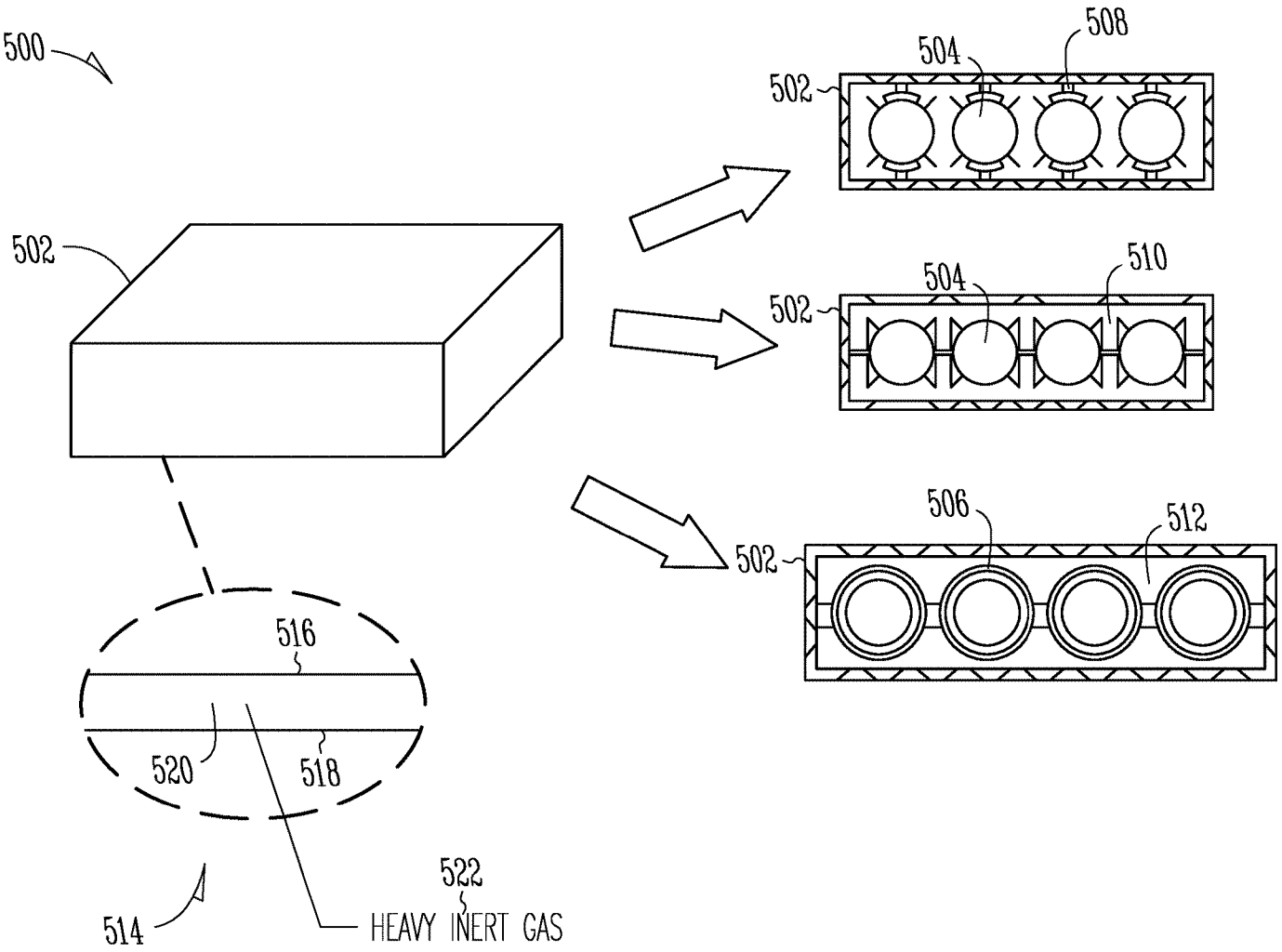
FIG. 5 illustrates an embodiment of a shipping container in which a heavy inert gas insulating layer is formed with the walls of the shipping container.

Referring now to FIG. 5, an embodiment of an energetic material container 500 includes a shipping container 502 with internal support features configured to engage a plurality of missile 504 or a plurality of launch tubes 506. In the top right configuration, the shipping container 502 includes a cradle system 508 that supports the missiles 504. In the middle configuration, the shipping container 502 includes dunnage 510 (packing material such as loose wood, matting or patterned foam) that supports the missiles 504. In the lower right configuration, the shipping container 502 includes a cradle system 512 that supports the launch tubes 506.

In each configuration, shipping container 502 is a double-walled structure that defines a hollow metal shell 514 having inner and outer metal walls 516, 518 that define a sealed void space 520. The double-walled structure may include ribs, a corrugated structure or the like to provide mechanical support. If included, this support is configured (e.g., with openings) such that the sealed void space 520 is a single contiguous volume. A vacuum is pulled on single contiguous volume, which is then filled with a heavy inert gas 522 at a pressure of 760 Torr (1 atm) or more (assuming operation of the rocket at or near sea level and room temperature of 25 C) and sealed to form a heavy inert gas insulation layer that surrounds the missile 504 or launch tube 506 with the possible exception of the top cover of the shipping container. The top cover may be a standard configuration or configured as a separate heavy inert gas insulating layer. In alternate embodiments, the canister could be divided into multiple sealed void spaces each defining a single contiguous volume that is filled with a heavy inert gas.

Figure 6B:
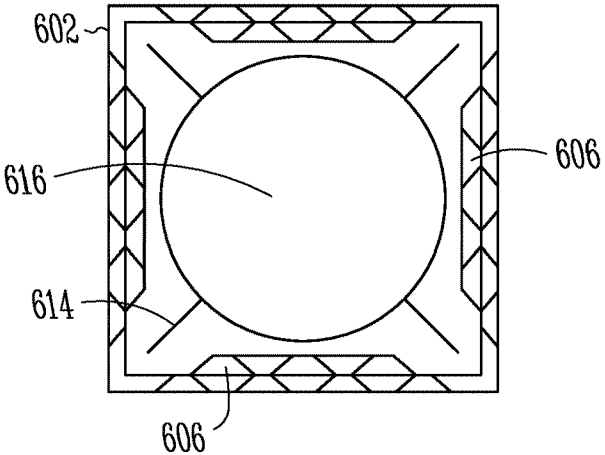
FIGS. 6A-6C illustrate embodiments in which a launch tube, a launch canister and a shipping container are retro-fit with a plurality of heavy inert gas inserts.
Figure 6C:
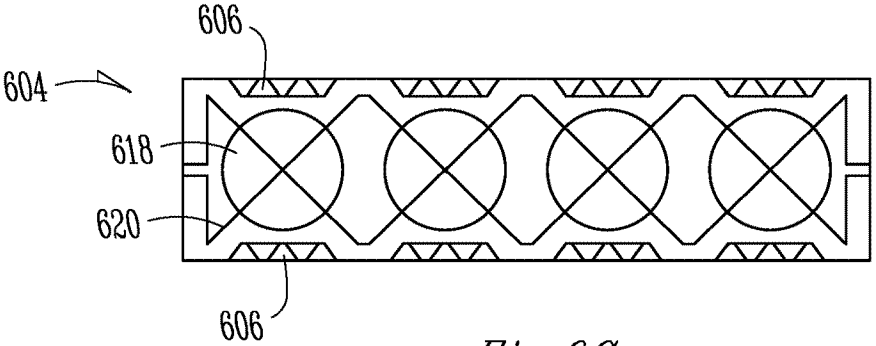
Figure 6A:
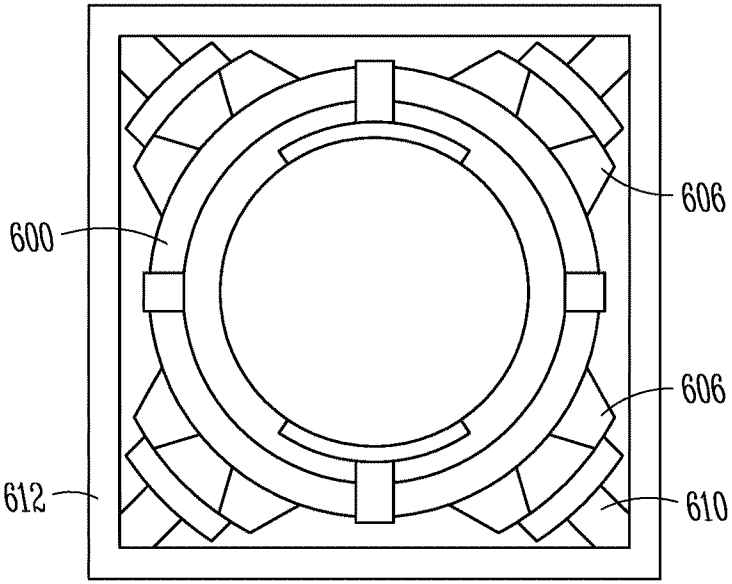

Referring now to FIGS. 6A through 6C, a launch tube 600, a launch canister 602 and a shipping container 604 may be retro-fit by attaching a plurality of heavy inert gas inserts 606 to the inner or outer (shown here) surfaces of the tube/canister/container. The tube/canister/container may be an existing double-walled air-filled container or may be a tube/canister/container implementing the heavy inert gas filled sealed double-walled construction, in which case the inserts provide additional thermal insulation.

As shown in FIG. 6A, four inserts 606 are attached to the outer surface of launch tube 600 between the launch tube and rail system 610 of a canister 612 and run the length of the launch tube.

As shown in FIG. 6B, four inserts 606 are attached to the inner surface of launch canister 602 and positioned to not interfere with the control surfaces 614 of a missile 616 and run the length of the canister.

As shown in FIG. 6C, inserts 606 are positioned on the inner walls of shipping container 604 on either side of a missile 618 and positioned to not interfere with the control surfaces 620 of missile 618 and run the length of the container.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

We claim:

1. An insulated container, comprising:

a hollow metal shell having inner and outer walls that define a sealed void space therein;

a component including an energetic material, said component positioned inside the hollow metal shell behind its inner walls;

internal support features that engage one or more physical features of the component to support the component inside the hollow metal shell; and an inert gas inside the sealed void space, the inert gas having a density of at least 1.5 $Kg/m^3$ and a thermal conductivity (Tcond_gas) of no greater than two-thirds of a thermal conductivity of air (Tcond_air) to form a heavy inert gas insulation layer to delay desensitization or inhibit premature reaction of the energetic material due to high external temperatures.

2. The insulated container of claim 1, wherein the sealed void space has a pressure of 760 Torr or greater.

3. The insulated container of claim 1, wherein the inert gas is Argon, Krypton Xenon or a synthetic gas.

4. The insulated container of claim 1, wherein the hollow metal shell includes a corrugated structure between the inner and outer walls, wherein the corrugated structure includes openings therein to contiguously define the sealed void space.

5. The insulated container of claim 1, further comprising an insulating layer formed of a burn resistant material on an interior surface of the inner walls of the hollow metal shell, the thermal conductivity of the inert gas being less than one one-hundredth the thermal conductivity of the burn resistant material.

6. The insulated container of claim 1, wherein the hollow metal shell has an opening, further comprising a cover adapted to the opening, said cover including a hollow metal shell that defines a sealed void space that is filled with the inert gas.

7. The insulated container of claim 1, wherein the hollow metal shell and cover form a heavy inert gas insulation layer around the component.

8. The insulated container of claim 1, further comprising:

a plurality of inserts positioned on an interior surface of the inner walls of the hollow metal shell so as not to interfere with the internal support features, each said insert having a hollow metal shell defining a sealed void space filled with the inert gas.

9. The insulated container of claim 1, further comprising:

a plurality of inserts positioned on an exterior surface of the outer walls of the hollow metal shell, each said insert having a hollow metal shell defining a sealed void space filled with the inert gas.

10. The insulated container of claim 1, wherein the container and component are one of, a launch tube and a missile;

a canister and one or more launch tubes;

a shipping container and a plurality of missiles; or a shipping container and a plurality of launch tubes.

11. An insulated container for containing a component including an energetic material, comprising:

a hollow metal shell having inner and outer walls that define a sealed void space therein;

internal support features configured to engage one or more physical features of the component to support the component inside the hollow metal shell behind its inner walls; and an inert gas inside the sealed void space, the inert gas having a density of at least 1.5 $Kg/m^3$ and a thermal conductivity (Tcond_gas) of no greater than two-thirds of a thermal conductivity of air (Tcond_air) to form a heavy inert gas insulation layer to delay desensitization or inhibit premature reaction of the energetic material due to high external temperatures.

12. The insulated container of claim 11, wherein the sealed void space has a pressure of 760 Torr or greater.

13. The insulated container of claim 11, wherein inert gas is Argon, Krypton Xenon or a synthetic gas.

14. An insulated container for containing a component including an energetic material, said insulated container having internal support features configured to engage one or more physical features of the component to support the component inside the container, comprising:

a plurality of inserts attached to the container, each insert having a hollow metal shell defining a sealed void space therein; and each insert's sealed void spacing containing an inert gas having a density of at least 1.5 $Kg/m^3$ and a thermal conductivity (Tcond_gas) of no greater than two-thirds of a thermal conductivity of air (Tcond_air) to form a heavy inert gas insulation layer to delay desensitization or inhibit premature reaction of the energetic material due to high external temperatures.

15. The insulated container of claim 14, wherein the inserts are spaced around an interior surface of the container so as not to interfere with the internal support features.

16. The insulated container of claim 15, further comprising an insulating layer formed of a burn resistant material on an interior surface of the inserts, the thermal conductivity of the inert gas being less than one one-hundredth the thermal conductivity of the burn resistant material.

17. The insulated container of claim 14, wherein each of the sealed void spaces has a pressure of 760 Torr or greater.

18. The insulated container of claim 14, wherein inert gas is Argon, Krypton Xenon or a synthetic gas.

19. The insulated container of claim 14, wherein said insulated container has a double-walled structure that defines a void space filled with air.

* * * * *